US012465968B2

(12) United States Patent
Jansen et al.

(10) Patent No.: US 12,465,968 B2
(45) Date of Patent: Nov. 11, 2025

(54) CLAMPING SYSTEM FOR A PRESS BRAKE COMPRISING TWO INTERNALLY INTERCONNECTED CAVITIES, PRESS BRAKE COMPRISING SUCH A CLAMPING SYSTEM, AND METHOD OF MANUFACTURING AN ELONGATE BEAM FOR SUCH A CLAMPING SYSTEM

(71) Applicant: WILA B.V., Lochem (NL)

(72) Inventors: Thomas Jan Herbert Jansen, Markelo (NL); Dennis Hermanus Johannes Rouhof, Harbrinkhoek (NL)

(73) Assignee: WILA B.V., Lochem (NL)

( * ) Notice: Subject to any disclaimer, the term of this patent is extended or adjusted under 35 U.S.C. 154(b) by 173 days.

(21) Appl. No.: 18/017,581

(22) PCT Filed: Jul. 16, 2021

(86) PCT No.: PCT/NL2021/050450
§ 371 (c)(1),
(2) Date: Jan. 23, 2023

(87) PCT Pub. No.: WO2022/019755
PCT Pub. Date: Jan. 27, 2022

(65) Prior Publication Data

US 2023/0302515 A1 Sep. 28, 2023

(30) Foreign Application Priority Data

Jul. 24, 2020 (NL) ..... 2026131

(51) Int. Cl.
*B21D 5/02* (2006.01)

(52) U.S. Cl.
CPC ..... *B21D 5/0236* (2013.01)

(58) Field of Classification Search
CPC ..... B21D 5/01; B21D 5/02; B21D 5/0209; B21D 5/0236; B21D 37/04
See application file for complete search history.

(56) References Cited

U.S. PATENT DOCUMENTS 6,516,649 B1 * 2/2003 Mika ..... B21D 5/0236 72/466.8
2006/0174679 A1 8/2006 Pabich
(Continued)

FOREIGN PATENT DOCUMENTS

CH 700207 A1 7/2010
EP 3501681 A1 6/2019
(Continued)

OTHER PUBLICATIONS

International Search Report and Written Opinion for the International Patent Application No. PCT/NL2021/050450, mailed Oct. 7, 2021, 9 pages.

*Primary Examiner* — Teresa M Ekiert
(74) *Attorney, Agent, or Firm* — KDW Firm PLLC

(57) ABSTRACT

A clamping system for a press brake includes an elongate beam having a receiving space for receiving a part of a bending tool. The elongate beam has at least two cavities formed therein, where each of the at least two cavities has an opening to the exterior of the elongate beam. The at least two cavities are interconnected internally. A press brake includes such a clamping system. A method of manufacturing an elongate beam for such a clamping system includes a step of providing a fluid connection to each of at least two cavities in the elongate beam by interconnecting the at least two cavities by machine from inside at least one of the at least two cavities.

15 Claims, 17 Drawing Sheets

(56) References Cited

U.S. PATENT DOCUMENTS

| | | | | |
|---|---|---|---|---|
| 2006/0191313 | A1* | 8/2006 | Harrington | B21D 5/0236 72/482.92 |
| 2018/0133774 | A1* | 5/2018 | Hilton | B21D 5/02 |

FOREIGN PATENT DOCUMENTS

| | | | |
|---|---|---|---|
| GB | 2057047 | A | 3/1981 |
| WO | 0059655 | A1 | 10/2000 |
| WO | 2010056110 | A1 | 5/2010 |

* cited by examiner

CLAMPING SYSTEM FOR A PRESS BRAKE COMPRISING TWO INTERNALLY INTERCONNECTED CAVITIES, PRESS BRAKE COMPRISING SUCH A CLAMPING SYSTEM, AND METHOD OF MANUFACTURING AN ELONGATE BEAM FOR SUCH A CLAMPING SYSTEM

This application is a national stage filing under 35 U.S.C. 371 of pending International Application No. PCT/NL2021/050450, filed Jul. 16, 2021, which claims priority to Netherlands Patent Application No. 2026131, filed Jul. 24, 2020, the entirety of which applications are incorporated by reference herein.

The invention relates to a clamping system for a press brake, the clamping system comprising an elongate beam comprising a receiving space for receiving a part of a bending tool, the elongate beam having at least two cavities formed therein, wherein each of the at least two cavities has an opening to the exterior of the elongate beam.

Press brakes are machines used for bending or folding sheet material, such as metal sheets. For that purpose, press brakes include a bottom beam and a top beam, which are movable with respect to each other. The top and bottom beams both hold tools, between which a workpiece is provided for bending. In general, bending tools of a press brake are exchangeable to allow making different types of bends or folds, and to allow servicing the tools. Therefore, press brakes are provided with a clamping system which can releasably clamp the tools. Clamping systems may be provided on the top beam of the press brake, on the bottom beam, or on both.

Two types of press brakes can be distinguished. The first type has a clamping system that is an integral part of either the top or bottom beam. A further clamping system may or may not be provided for the other of the top or bottom beam. Such a clamping system, that is an integrated one, can not be detached from its top or bottom beam, and is itself thus not exchangeable with another clamping system, whereas the tools the clamping system can hold are exchangeable. The second type has an exchangeable clamping system that can be fixedly connected to either the top beam or the bottom beam. A further clamping system may or may not be provided for the other of the top or bottom beam. The exchangeable clamping system allows exchanging tools, but can also be detached from its top or bottom beam, for instance for maintenance or for exchanging it for another clamping system. This is in the art used to make one press brake suitable for different tooling types, which may require different clamping systems, and/or to service the clamping system.

Further clamping systems exist that can be clamped by other clamping systems as if they were a tool. Such clamping systems can for instance be clamped by a system for tools of a first type, whereas they themselves can clamp tools of a second type, so that such clamping systems act as an adaptor between a clamping system and a tool that would otherwise be incompatible.

The invention relates to clamping systems integrated with press brakes, be it the bottom beam or top beam, exchangeable clamping systems, and clamping systems acting as an adaptor, and to a method of making an elongate beam for any such clamping system.

A press brake and a clamping system therefor are known, for instance from applicant's earlier application WO 2010/056110 A1, which describes a clamping device for clamping a tool. The clamping device includes an actuated member and an engaging member. The actuated member is driven for instance hydraulically or pneumatically.

Although the clamping device described in WO 2010/056110 A1 has performed satisfactory, and to this day still does, a need exists to further improve the clamping device. This need exists in particular in increasing the reliability and in improving ease of manufacturing.

Therefore, the invention aims to provide a clamping system that is more reliable and can be manufactured relatively easily.

According to the invention, this aim is achieved by a clamping system for a press brake according to the preamble, characterized in that the at least two cavities are interconnected internally.

The cavities in the elongate beam may be used to house drive means, for instance for driving an actuating member of the clamping system, such as a piston. In particular, the cavities may each house a piston of an hydraulic or pneumatic actuation system, the piston preferably acting directly on a clamping element for engaging a tool in a receiving space of the elongate beam. The clamping element may be movable between a first position, in which it may engage on the bending tool for clamping it in the receiving space, and a second position for releasing the bending tool. Accordingly, the piston may constitute an actuating member.

It is envisioned the cavities extend parallel to each other at a distance from each other as seen in the length direction of the elongate beam. Accordingly, multiple drive means can be arranged along the length of the elongate beam to clamp multiple tools or to clamp a tool at multiple locations.

Since multiple drive means or parts thereof are provided in multiple cavities, a need exist to interconnect the cavities. By connecting the cavities internally, no external interconnection needs to be provided for the two connections. Accordingly, the added manufacturing effort to provide the external interconnection is no longer needed. Moreover, external connections, which can comprise e.g. conduits or wiring, are liable to failure due to them being exposed to external factors. Further, a point of connection between the elongate beam and the external interconnection may be prone to damage or failure, or require regular servicing. Accordingly, by providing the internal interconnection, the clamping system is less susceptible to failure and therefore more reliable. Accordingly, less service may be needed.

In particular, when the conduits carry hydraulic or pneumatic fluid, it takes a relatively long amount of time for the fluid to move through the conduits, and the conduits impose a relatively high resistance to flow on the fluid. Thus, by providing said internal connection, less time and/or pressure may be needed to move the hydraulic or pneumatic fluid, which in turn may aid in moving the clamping element faster. A tool can thereby be released and/or replaced faster.

Moreover, the cavities may be used directly as pressure chambers of a pneumatic or hydraulic drive system, for instance by inserting a piston in the cavities as will be explained below.

Additionally or alternatively, manufacturing the clamping system may be relatively easy, as no additional components need to be provided and installed for the external connection.

It is noted that internal herein refers to internal of the elongate beam. External herein refers to external of the elongate beam.

The at least two cavities may be formed integrally in the elongate beam, as opposed to being formed in a separate body fixed to the elongate beam.

This may present the advantage that no such separate body need be provided and later fixed and/or sealed to the elongate beamed. Accordingly, the clamping system is simplified, thereby removing possible points of failure and simplifying the manufacturing process. Moreover, the separate body would introduce an additional source of error in mutually positioning parts of the press brake, in particular in positioning the cavity with respect to the clamping element.

Additionally or alternatively, forming the at least two cavities integrally in the elongate beam may make it possible to produce the clamping system relatively cost efficiently.

The interconnection may be provided as a channel between the at least two cavities cut out of the material of the elongate beam.

In an embodiment of the clamping system, the clamping system further comprises a channel extending from at least one of the at least two cavities to an exterior of the elongate beam.

The channel may be used to supply the cavities or components therein with appropriate in- and/or output, for instance by running conduits and/or wiring through the channel. In particular, the channel could itself form a conduit through which a fluid could flow to the at least one of the at least two cavities. Such a fluid could be a hydraulic or pneumatic fluid.

The other of the at least two cavities could be provided with the same in- and/or output via its interconnection with the at least one of the at least two cavities.

In another embodiment of the clamping system, the at least two cavities are interconnected via their respective side walls.

Providing the interconnection in the side walls aids in preserving the structural rigidity of the elongate beam, since less material of the elongate beam needs to be removed to form the interconnection via the side walls, in particular since the cavities may be arranged next to each other, their respective side walls facing each other. Moreover, the interconnection may be provided in the side wall with relative ease as is explained below.

In yet another embodiment of the clamping system, the at least two cavities are interconnected at an end zone of the cavities that is opposite the opening of the respective cavity.

In this embodiment, the opening is left free, so that it can be used for instance for drive means in the cavities to engage on an actuating member of the clamping system. By placing the interconnection away from the opening, the drive means can be provided with in- and/or output through the interconnection, without interfering with operation of the drive means.

In yet another embodiment of the clamping system, the clamping system further comprises a cylinder in each of the at least two cavities.

The cylinder may be used as part of a pneumatic or hydraulic drive system for driving the clamping system, for instance for driving an actuating member of the clamping system.

The cylinder may be supplied with pneumatic or hydraulic fluid via the interconnection between the cavities, and/or via the channel. For this purpose, the pneumatic or hydraulic fluid may flow directly through the interconnection and/or the channel, or conduits may be provided which run through the interconnection and/or the channel.

In yet another embodiment of the clamping system, the clamping system further comprises a piston in each of the at least two cavities or in each cylinder in each of the at least two cavities.

The piston may be used as part of the pneumatic or hydraulic drive system for driving the clamping system, for instance for driving an actuating member of the clamping system. The piston may be movable in the cylinder inside the cavity and be configured to cooperate therewith, or the piston may be movable directly in the cavity and be configured to cooperate therewith. In the latter case, the cavity itself can serve as a cylinder for cooperation with the piston. In this case, no conduits are necessary, as pneumatic or hydraulic fluid can flow between the two cavities via the interconnection between them.

The invention also relates to a press brake comprising at least one clamping system as described above. The clamping system may have any of the above-described features, alone or in any suitable combination.

The clamping system may be arranged in a top beam of the press brake, in a bottom beam of the press brake, or in both. The clamping system may be a separate, exchangeable clamping system, often referred to into the art as clamping beam, or may be an integral part of the press brake.

The invention also relates to a method of manufacturing an elongate beam for a clamping system for a press brake, the elongate beam comprising a receiving space for receiving a part of a bending tool, the method comprising the steps of:

a) providing an elongate beam; and b) forming at least two cavities in said elongate beam, each of the two cavities having an opening to the exterior of the elongate beam;

c) providing a fluid connection to each of the at least two cavities.

characterized in that providing the fluid connection is performed by interconnecting the at least two cavities by inserting a tool into at least one of the at least two cavities through its opening, and machining towards another one of the at least two cavities.

According to the method, the interconnection between the at least two cavities is provided from the inside of a cavity towards another. As such, an interconnection can be provided that is internal to the elongate beam. As a result, the at least two cavities can be interconnected internally. This has the advantages described above in relation to the clamping system.

The method may be used to manufacture an elongate beam for use in a clamping system as described above, and may as such comprise the above-described features, alone or in any suitable combination.

In an embodiment of the method, step c) is performed by machining from the one of the at least two cavities until the one of the at least two cavities is interconnected with the other one of the at least two cavities.

In this embodiment, machining from one cavity to another takes place in a single direction. Accordingly, once means for machining have been set up in one cavity, machining can continue until the interconnection has been completed. This may aid in efficiently providing the interconnection. Moreover, there is no need to set up means for machining in the opposite direction from the other cavity, which reduces the total time needed for setting up the means for machining.

Further, as compared to an alternative wherein the interconnection is provided by machining from both cavities towards the other, it is not necessary to align the machine directions from each cavity, and to adjust the machining depths to each other.

In another embodiment of the method, the method further comprises forming a channel from at least one of the at least two cavities to an exterior of the elongate beam.

In yet another embodiment of the method, the method further comprises providing the interconnection in a side wall of the at least two cavities.

In yet another embodiment of the method, the method further comprises providing the interconnection in an end zone opposite the opening of each cavity.

In yet another embodiment of the method, the method further comprises inserting a cylinder into each of the at least two cavities.

In yet another embodiment of the method, the method further comprises inserting a piston into each of the at least two cavities or into the cylinders inserted therein;

In yet another embodiment of the method, the method comprises inserting the tool in an insertion direction and consecutively moving the tool in a machining direction, wherein the machining direction is at a non-zero angle with the insertion direction, preferably wherein the machining direction is substantially perpendicular to the insertion direction.

Accordingly, the interconnection can be provided e.g. in a side wall of the cavity and/or near an end zone removed from the opening of the cavity. The interconnection can extend laterally away from the cavity, so that cavities adjacent to each other, with respective side walls facing each other, as is the case with cavities arranged parallel to each other, can be interconnected.

In yet another embodiment of the method the tool comprises a shaft and a head, the head having a larger cross-sectional dimension than the shaft.

Using such a tool may avoid damage to the side wall of the cavity while machining.

In yet another embodiment of the method step c) is performed by milling A suitable milling tool may be used therefor.

The applicant has found that a suitable interconnection between cavities can be provided internally by milling.

In yet another embodiment of the method step b) is performed by milling or drilling.

The applicant has found that a suitable channel can be formed by milling or drilling. The channel may be formed from the outside of the elongate beam towards a cavity therein, for instance by drilling.

In yet another embodiment of the method, the method further comprises forming the cavities in step b) in a part of the elongate beam that is integral with the part of the elongate beam comprising the receiving space.

To the best of applicant's knowledge, press brakes so far have had cavities arranged in a separate body fixed to the elongate beam. This not only creates the need to provide a reliable fixing of the separate body to the elongate beam, but in many cases also requires suitable sealing of the separate body to the elongate beam. Even though adequate fixing and sealing techniques exist, both the fixing and the sealing remain points of possible failure, and must as such be serviced and/or inspected regularly to avoid failure of or damage to the clamping system. By forming the cavity integrally in the elongate beam, no separate body is needed. Accordingly, there is no fixing and/or a sealing of such a body which could constitute failures. Therefore, the clamping system is able to operate more reliably, and/or requires less servicing and/or inspection.

The invention will be further elucidated with reference to the attached drawings, in which:

FIGS. 3B, 3C, 5, 6, 7B, 7C, 8, 9 and 12 show views from the same side as that of FIGS. 1A and 2A.

In the figures, like elements are referred to with like reference numerals. Corresponding elements of different embodiments are referred to with reference numerals increased by a multiple of one hundred (100).

Figure 1A:
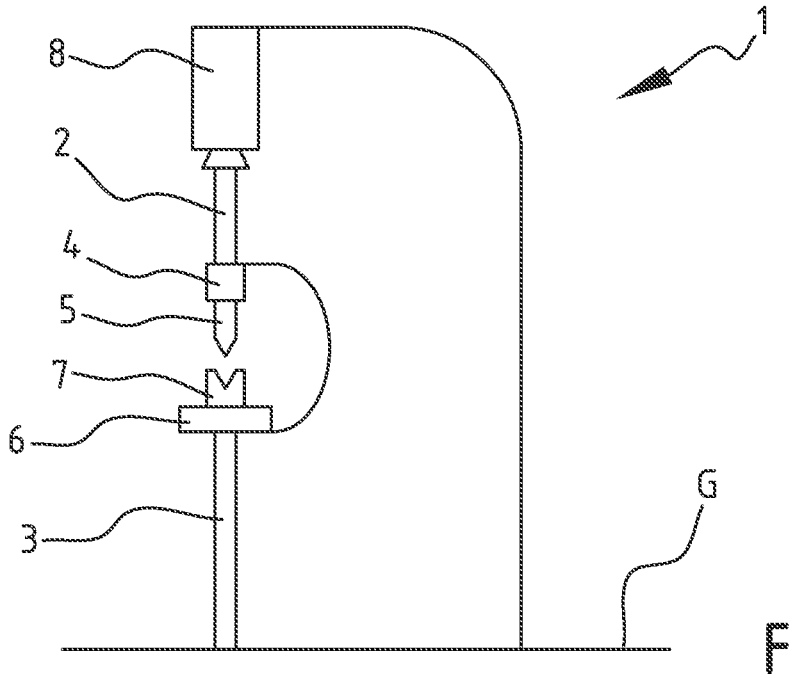
FIGS. 1A and 1B show schematically a cross-sectional side view and a front view respectively of a press brake with an exchangeable clamping system.
Figure 1B:
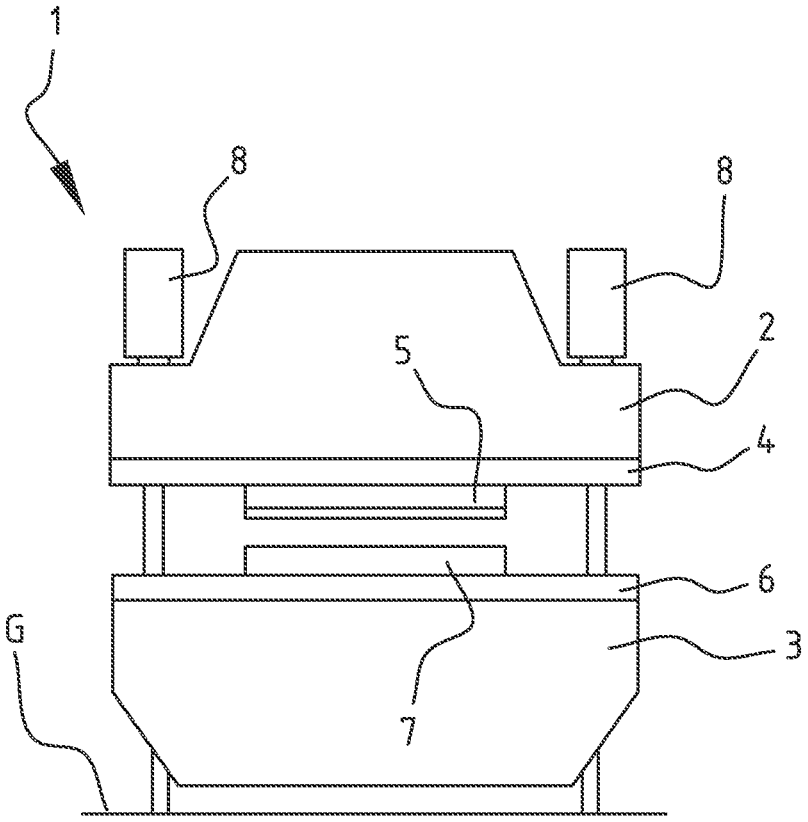

FIGS. 1A and 1B show a press brake 1 placed on a ground surface G. The press brake 1 includes a top beam 2 and a bottom beam 3. The top beam 2 is provided with a top clamping system 4. The clamping system releasably holds a top tool 5. The bottom beam 3 is provided with a bottom clamping system 6, which releasably holds a bottom tool 7. The top beam 2 and the bottom beam 3 are moveable towards and away from each other by means of hydraulic systems 8. Accordingly, the top and bottom tools 5, 7 are also moveable towards and away from each other. To bend sheet metal, the sheet is inserted between the tools 5, 7 which are then moved towards each other. The top tool 5 then forces the sheet metal into the bottom tool 7 in order to deform the sheet metal by bending. After bending, the tools 5, 7 are moved away from each other by moving the top beam 2 via the hydraulic systems 8. The clamping systems 4, 6 are releasably attached to the top and bottom beam 2, 3 respectively via a suitable locking system. Accordingly, the clamping systems 4, 6 can be exchanged for clamping systems suitable for other tools, or the clamping systems 4, 6 can be taken out for servicing them.

Figure 2A:
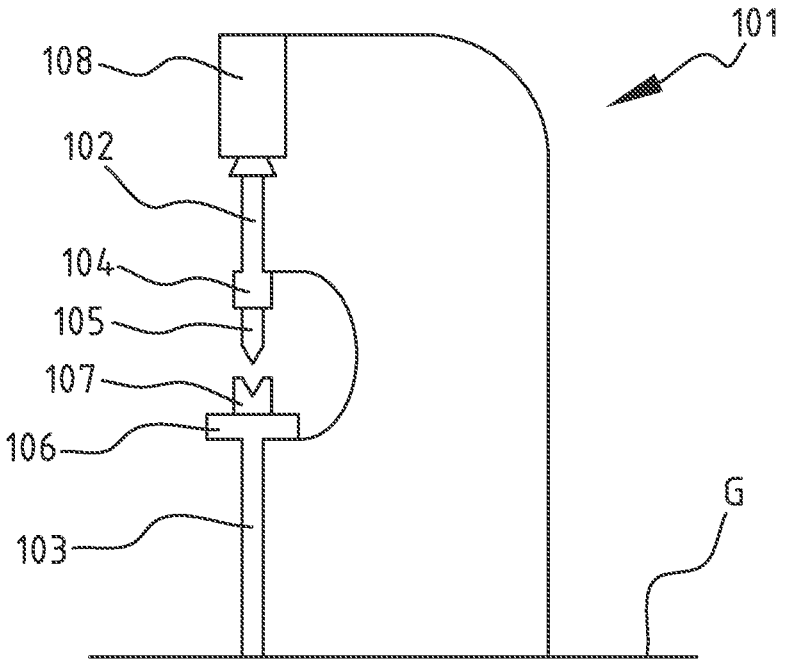
FIGS. 2A and 2B show schematically a cross-sectional side view and a front view respectively of a press brake with an integrated clamping system.
Figure 2B:
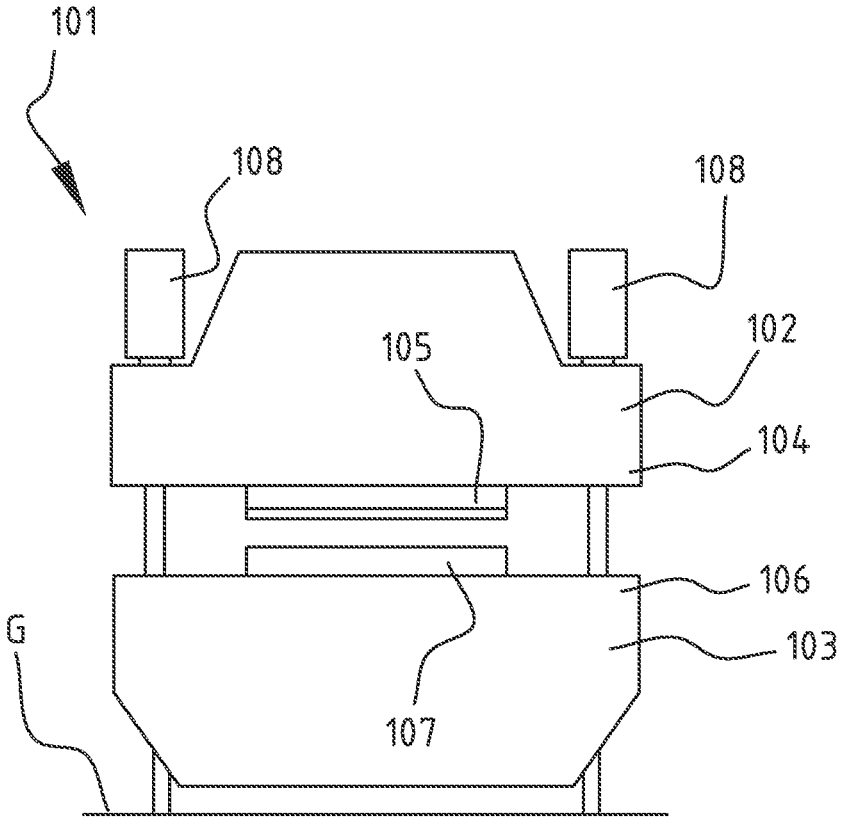

FIGS. 2A and 2B show a similar press brake 101, which will be described here only in as far as it differs from the press brake 1 in of FIGS. 1A and 1B. The clamping systems 104, 106 of the press brake in FIGS. 2A and 2B are integrated with the top and bottom beams 102, 103 respectively. As such, the clamping systems 104, 106 are not exchangeable. The tools 105, 107 held by the clamping systems 104, 106 are exchangeable.

Figure 3A:
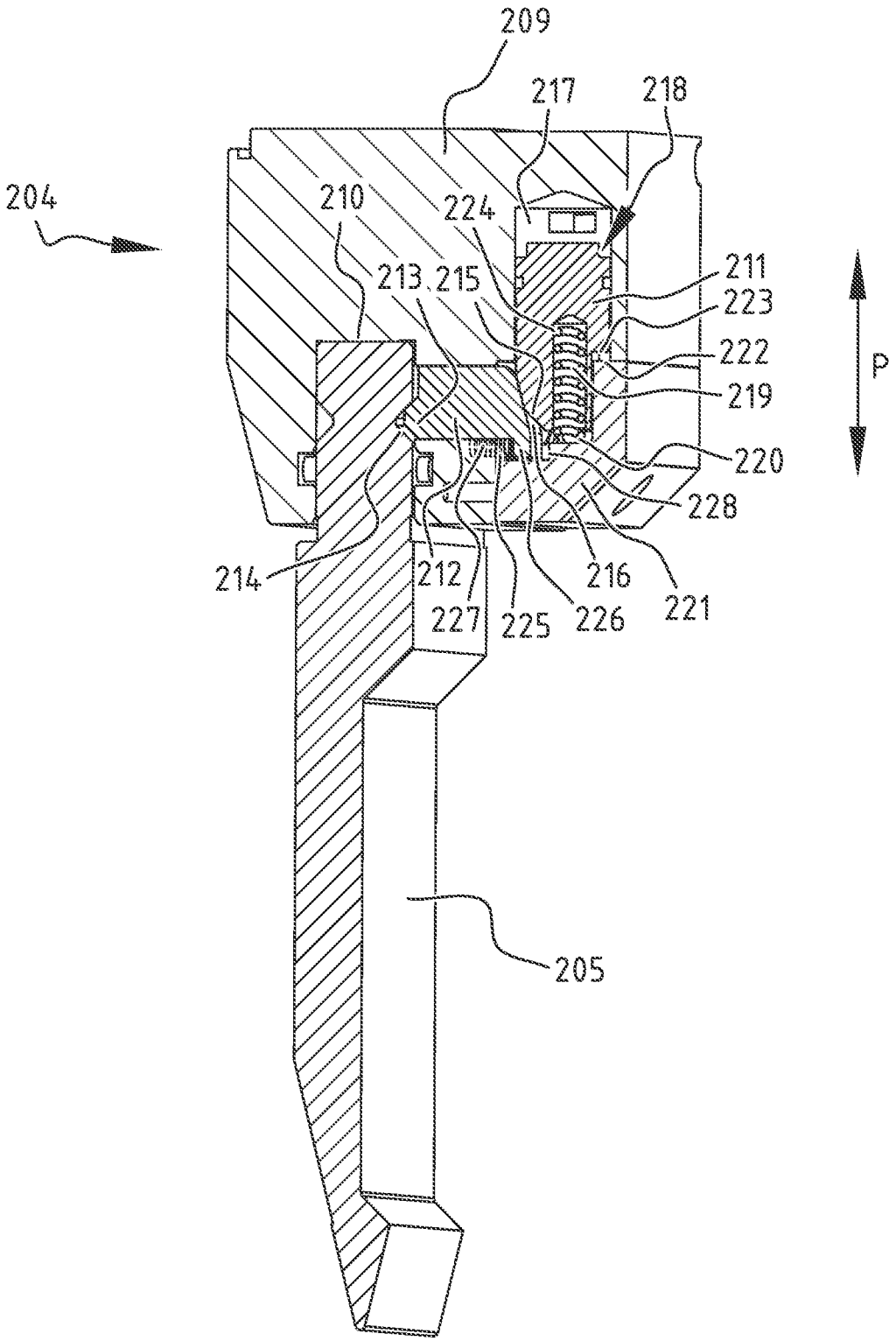
FIGS. 3A-3C show schematically a clamping system and a tool in perspective and transversal cross-sectional views.
Figure 3B:
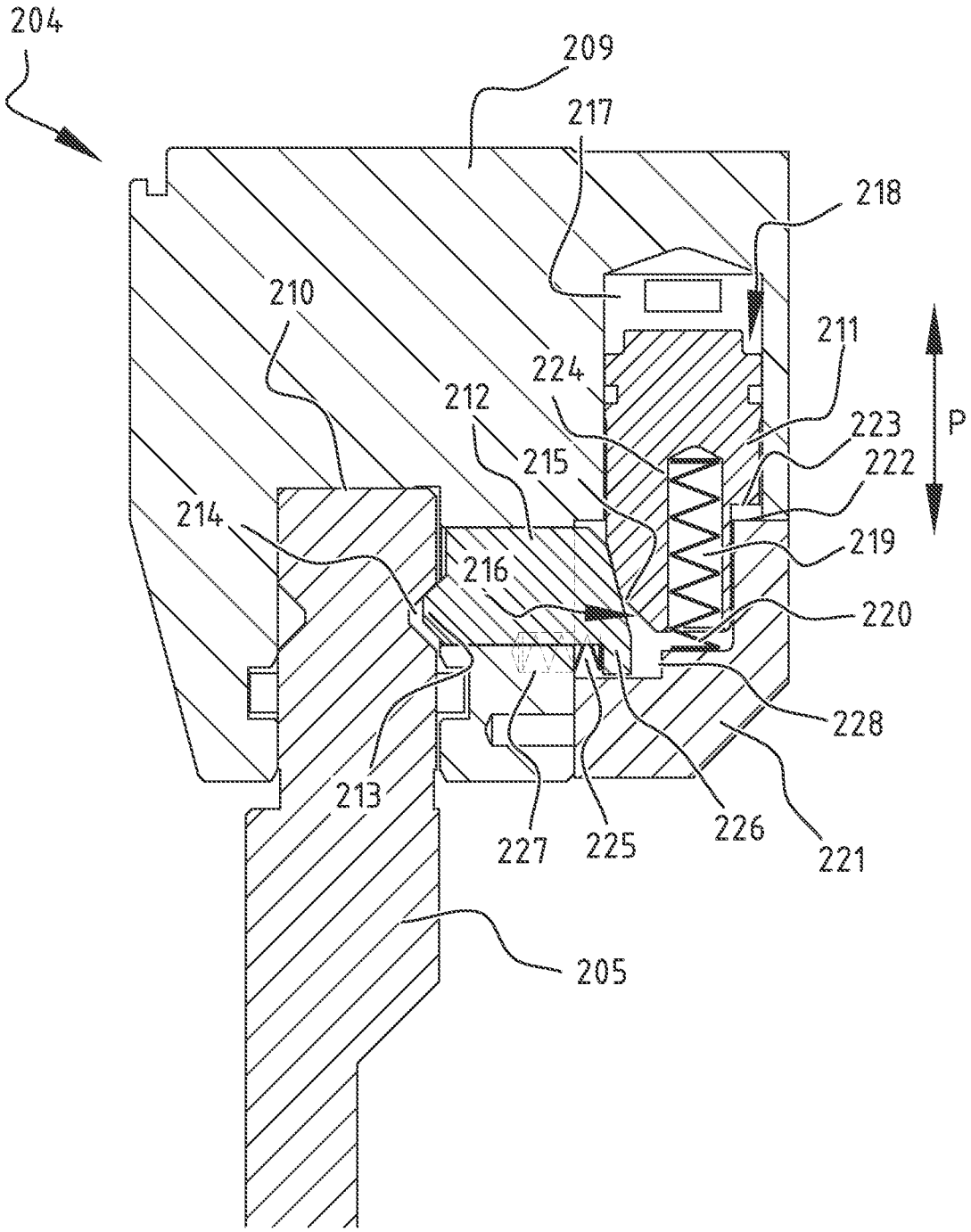
Figure 3C:
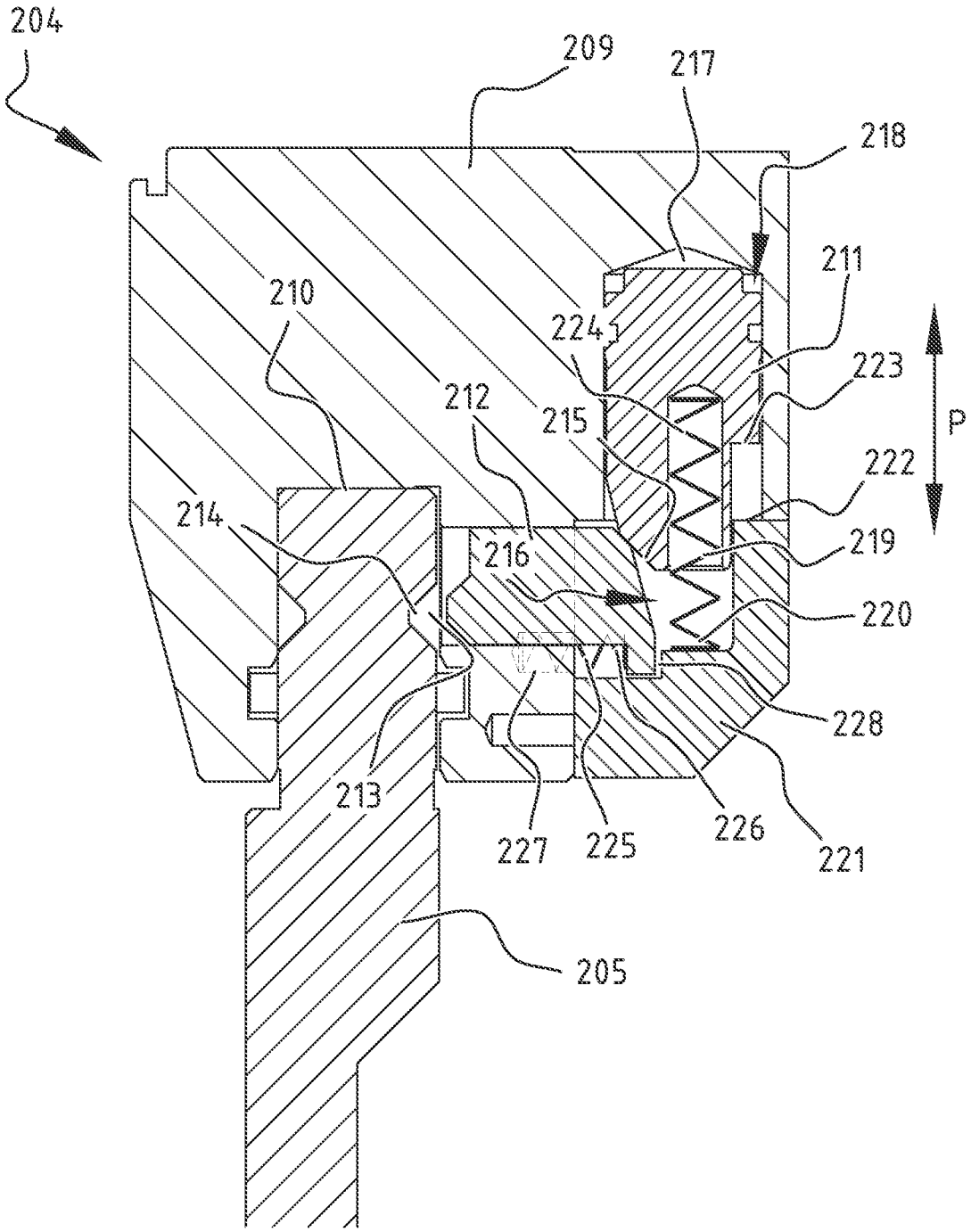

FIGS. 3A-3C show a clamping system 204, that could for instance be used in a press brake shown in FIGS. 1A-2B. The clamping system 204 has as a main body an elongate beam 209. A receiving space 210 in the elongate beam 209 accommodates a part of tool 205. The clamping system further comprises an actuating member 211 and a clamping element 212. The actuating member 211 is moveable upwards, to an inactive position, and downwards, to an active position. The clamping element 212 is moveable between a first position, in which it extends into the receiving space 210 for engaging on the tool 205, and a second position, in which it is retracted away from the receiving space 210 to release the tool. The clamping element 212 has an engaging tip 213 which cooperates with an engaging recess 214 in the tool 205 in order to clamp the tool 205 securely in the receiving space 210. In the active position, the actuating member 211 engages the clamping element 212 and urges it towards the receiving space 210. FIG. 3B shows the actuating member 211 in the active position, so that the tool 205 is clamped in the receiving space 210 by the clamping element 212. The actuating member 211 has for the purpose of engaging the clamping element 212 an inclined engaging surface 215 which engages on a similarly cooperating inclined engaging surface 216 of the clamping element 212. Accordingly, when the actuating member 211 moves to its active position, i.e. downwards in the figures, the engaging surface 215 of the actuating member 211 engages the engaging surface 216 of the clamping element 212 and, due to its inclination, urges the clamping element 212 to its first position, i.e. leftwards in the figures. FIG. 3C shows the actuating element 211 in its inactive position, with the clamping element 212 retracted away from the receiving space 210 to its second position, thereby releasing the tool 205.

The actuating member 211 is movably arranged in a pressure chamber 217. The pressure chamber 217 is made directly into the elongate beam 209, which also has the receiving space 210. The pressure chamber 217 is thus integrally formed in the elongate beam 209. The actuating member 211 is provided with sealing means 218 which seal the actuating member 211 to the wall of the pressure chamber 217, i.e. to the inside of the elongate beam 209. As such, the actuating member 211 works as a piston moveable in the pressure chamber 217, which accordingly works as a cylinder. Accordingly, the actuating member 211 can be pushed towards its active position by introducing a fluid in the pressure chamber 217. The pressure chamber 217 of this clamping system 204 is adapted for receiving a hydraulic liquid as pressure fluid, in order to move the actuating member 211.

The clamping system 204 is provided with a first biasing member in the form of a first compression spring 219. The first compression spring acts on the actuating member 211. The first compression spring 219 is arranged vertically, which corresponds to the pressing direction P defined by the clamping system 204, and the depth direction of the receiving space 210. The first compression spring 219 biases the actuating member 211 upwards, i.e. towards its inactive position. Accordingly, when pressure of the hydraulic liquid in the pressure chamber 217 is stopped, the first compression spring 219 pushes the actuating member 211 upwards further into the pressure chamber 217 thereby forcing the hydraulic fluid to flow out of the pressure chamber 217. The first compression spring 219 supports on a support 220 provided by a cover 221. The cover 221 covers clamping element 212, the actuating element 211 and the pressure chamber 217. The cover 221 also forms a first stop 222 for the actuating member 211 to hit, in order to limit movement of the actuating member 211 beyond the active position. The actuating member 211 has a movement limiter 223 for engaging the first stop 222. The first compression spring 219 extends partly in a first cavity 224 in the actuating member 211. A second biasing member is provided in the form of a second compression spring 225. The second compression spring 225 is arranged horizontally, i.e. perpendicular to the pressing direction P and a longitudinal direction of the elongate beam 204. The second compression spring 225 acts on the clamping element 212 via a protrusion 226 thereof. the first compression spring 225 extends partly in a second cavity 227 in the elongate beam. The cover 221 also provides a second stop 228 for engaging the protrusion 226 of the clamping element 212, to limit the movement of the clamping element 212 beyond its second position.

Figure 4A:
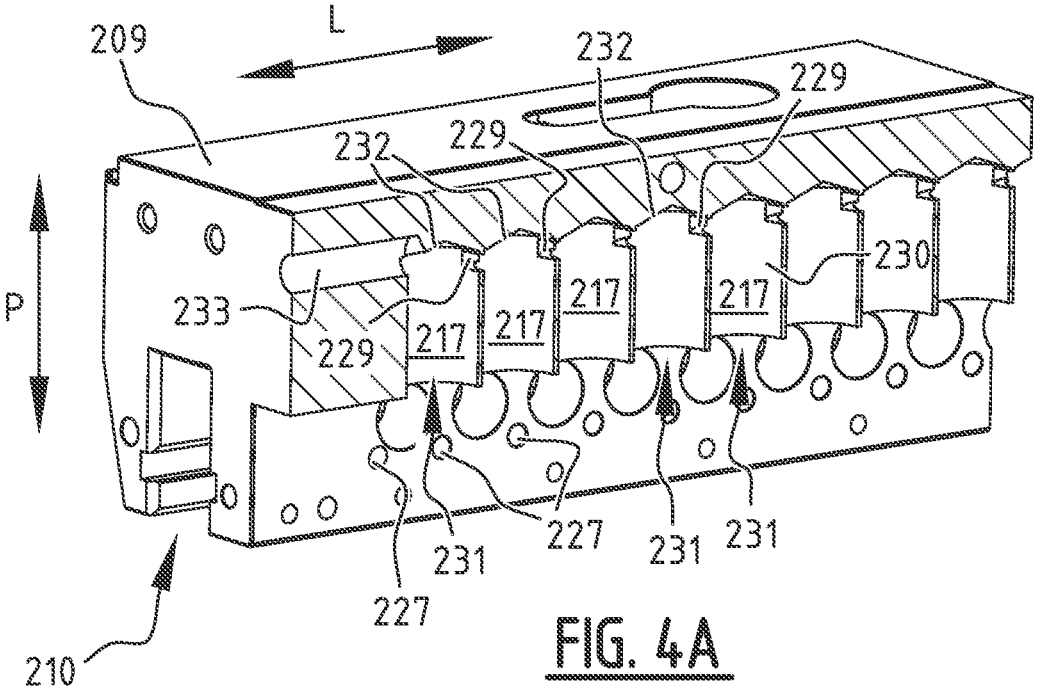
FIGS. 4A and 4B show schematically a perspective view and a longitudinal cross-sectional view of an elongate beam of the clamping system of FIGS. 3A-3C.
Figure 4B:
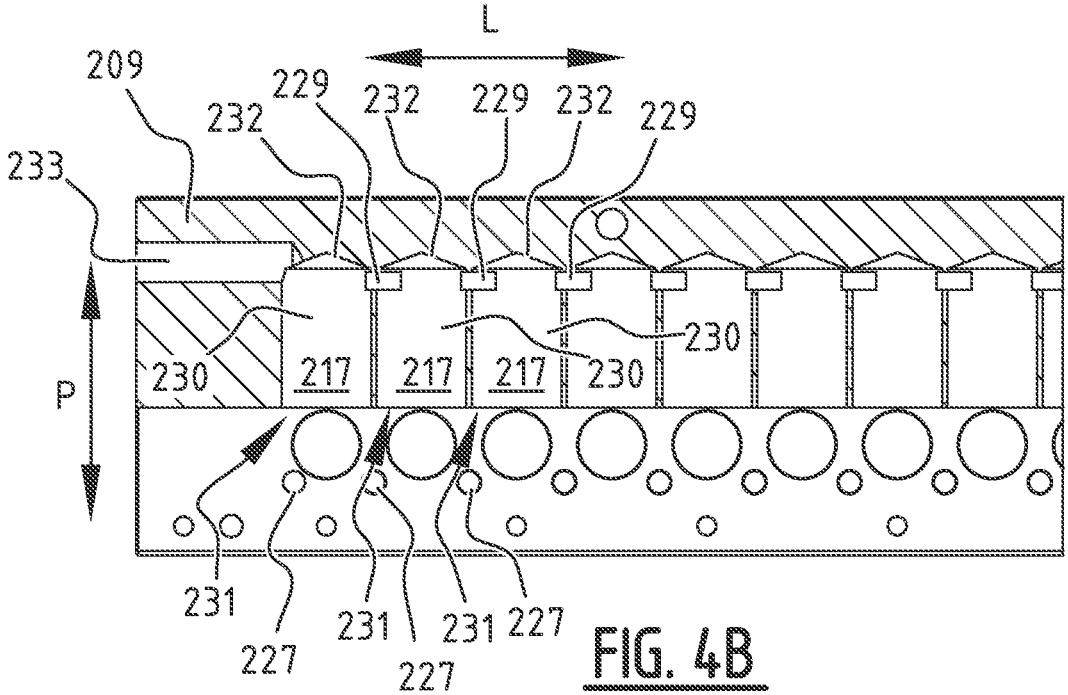

FIGS. 4A and 4B show the elongate beam 209 of the clamping system 204 described above in more detail. Repeating elements in FIGS. 4A and 4B have not been provided with reference numerals in each instance. As can be seen, multiple pressure chambers 217 are lined up in the elongate beam 209 in its longitudinal direction L. The pressure chambers 217 are connect to each other, i.e. interconnected, via interconnections consisting of channels 229 extending between side walls 230 of adjacent pressure chambers 217. The pressure chambers 217 have an opening 231 on one end, and are closed on the other end 232. The channels 229 are provided close to said other end 232. One pressure chamber 217 is connected to the external of the elongate beam 209 via a channel 233. It is visible from FIGS. 4A and 4B, that the pressure chambers 217 are arranged in the elongate beam 209 integrally, in the same piece of material comprising the receiving space 210. The pressure chambers 217 are interconnected internally, since the interconnection is made via channels 229 that do not reach the outside of the elongate beam 209.

Figure 5:
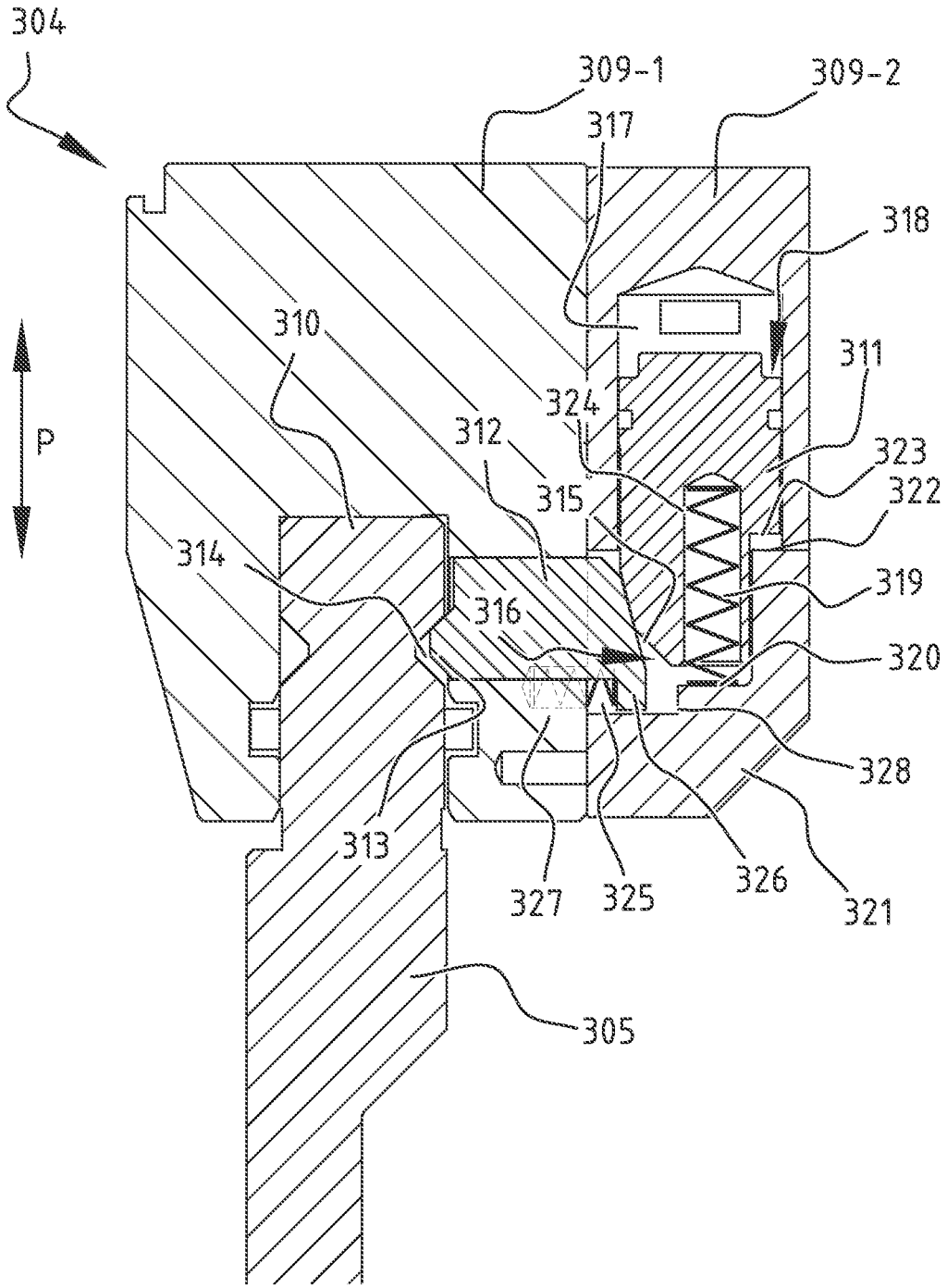
FIG. 5 shows schematically a variation on the clamping system of FIGS. 3A-5.

FIG. 5 shows a clamping system 304 that differs only from the above described clamping system 204 in that its elongate beam 309 is comprised of two separate components 309-1 and 309-2. The main body 309-1 of the elongate beam can be manufactured separate from the auxiliary body 309-2, and attached to it later. The pressure chamber 317 is formed in the auxiliary body 309-2.

Figure 6:
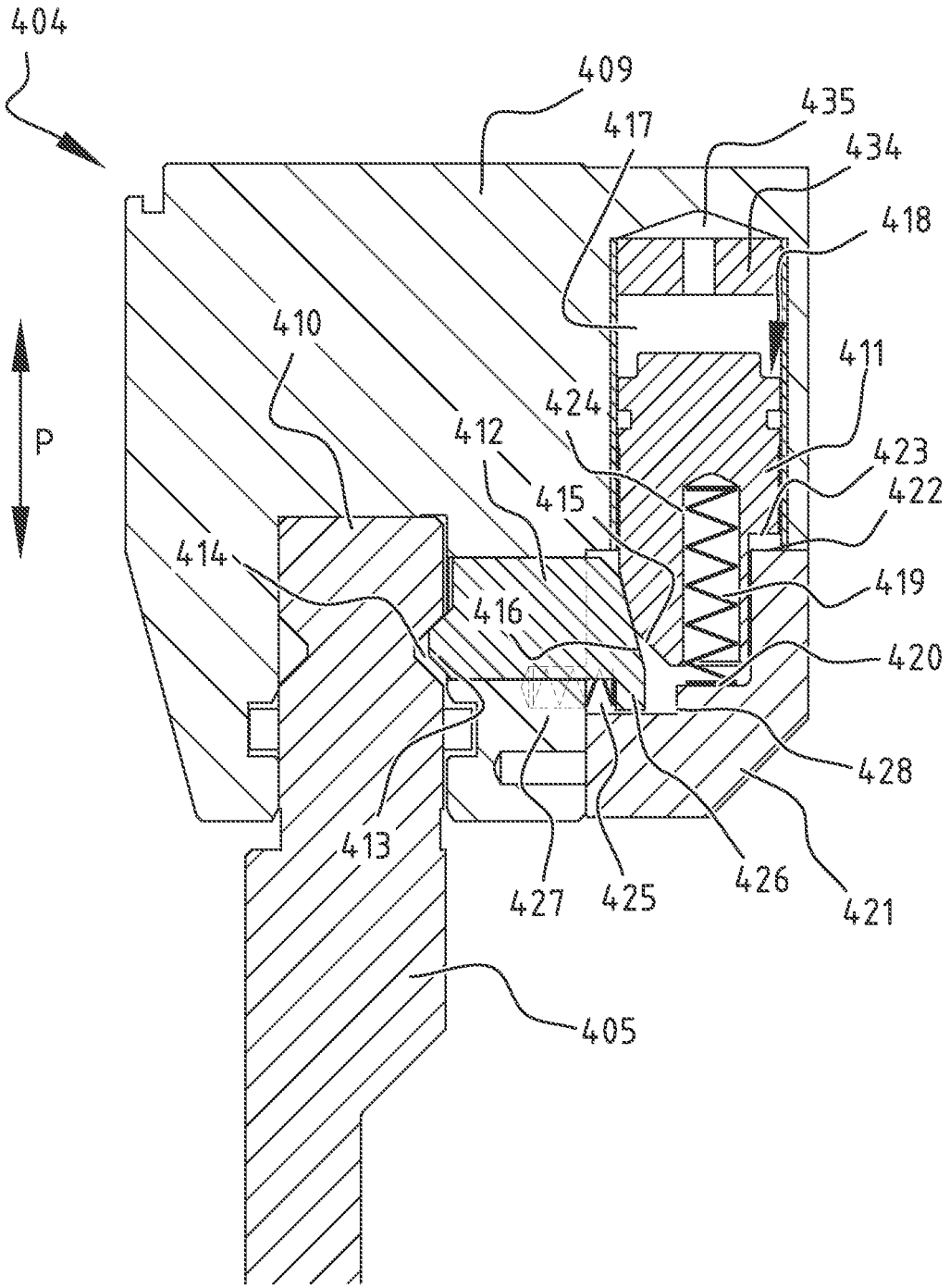
FIG. 6 shows schematically a variation on the clamping system of FIGS. 3A-5.

FIG. 6 shows a clamping system 404 that differs only from the clamping system 204 described in relation to FIGS. 3A-4B in that the pressure chamber 417 is formed within a cylinder 434 which is placed in a cavity 435 in formed integrally the elongate beam 409. It is of course possible to provide the cavity 435 in an auxiliary body as described with respect to FIG. 5, thereby combining the differing features of FIGS. 5 and 6.

Figure 7A:
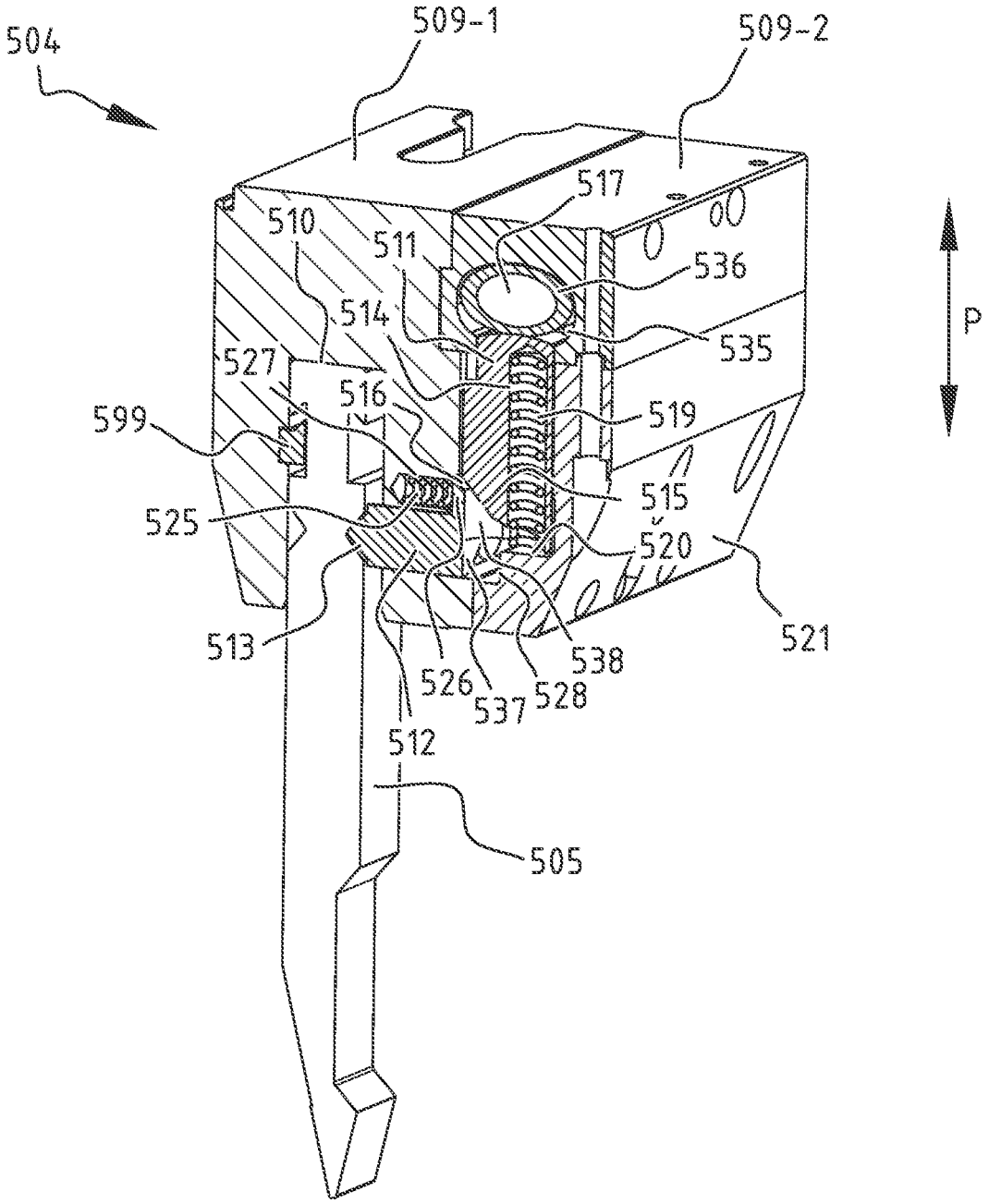
FIGS. 7A-7C show schematically another clamping system and a tool in perspective and side views.
Figure 7B:
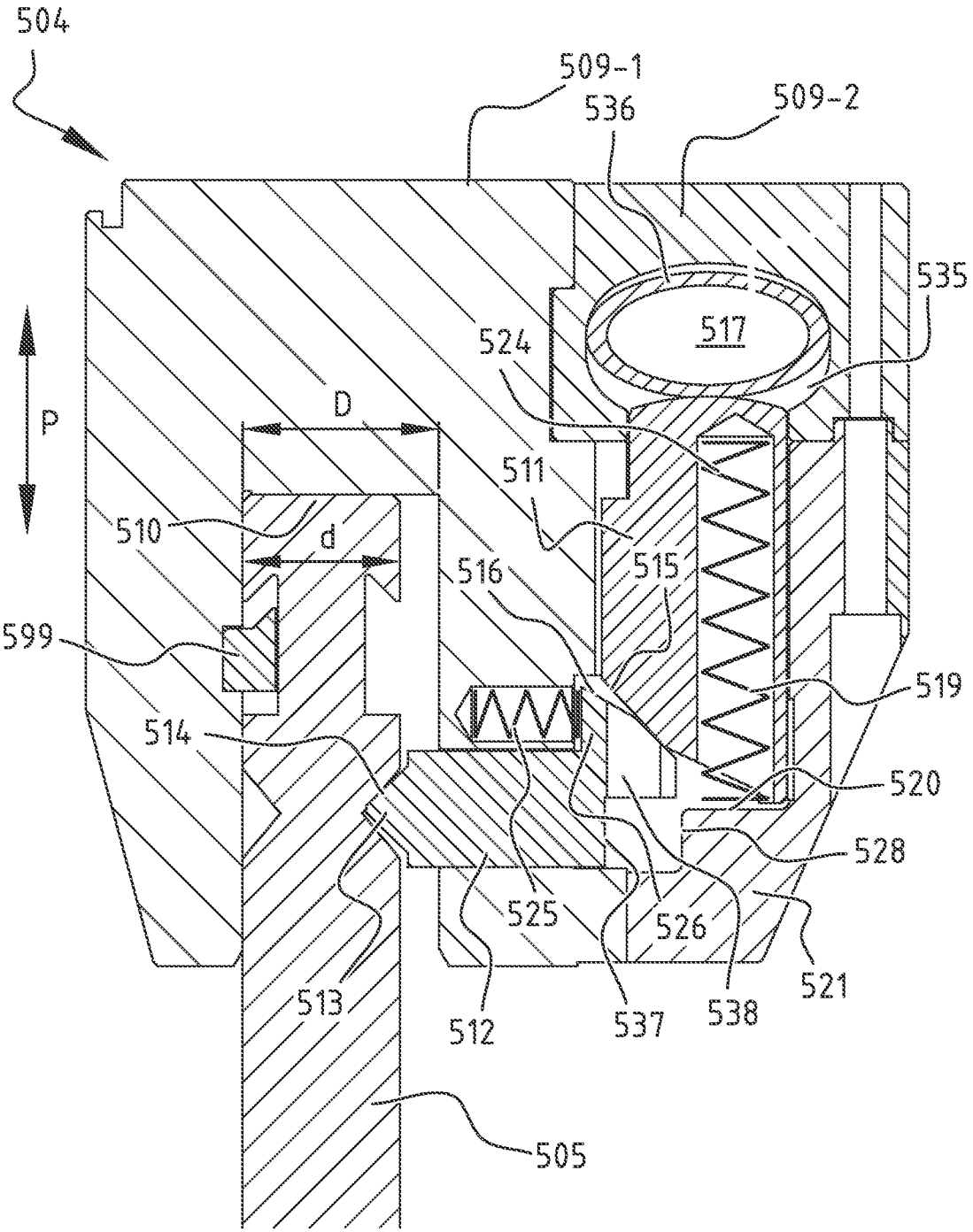
Figure 7C:
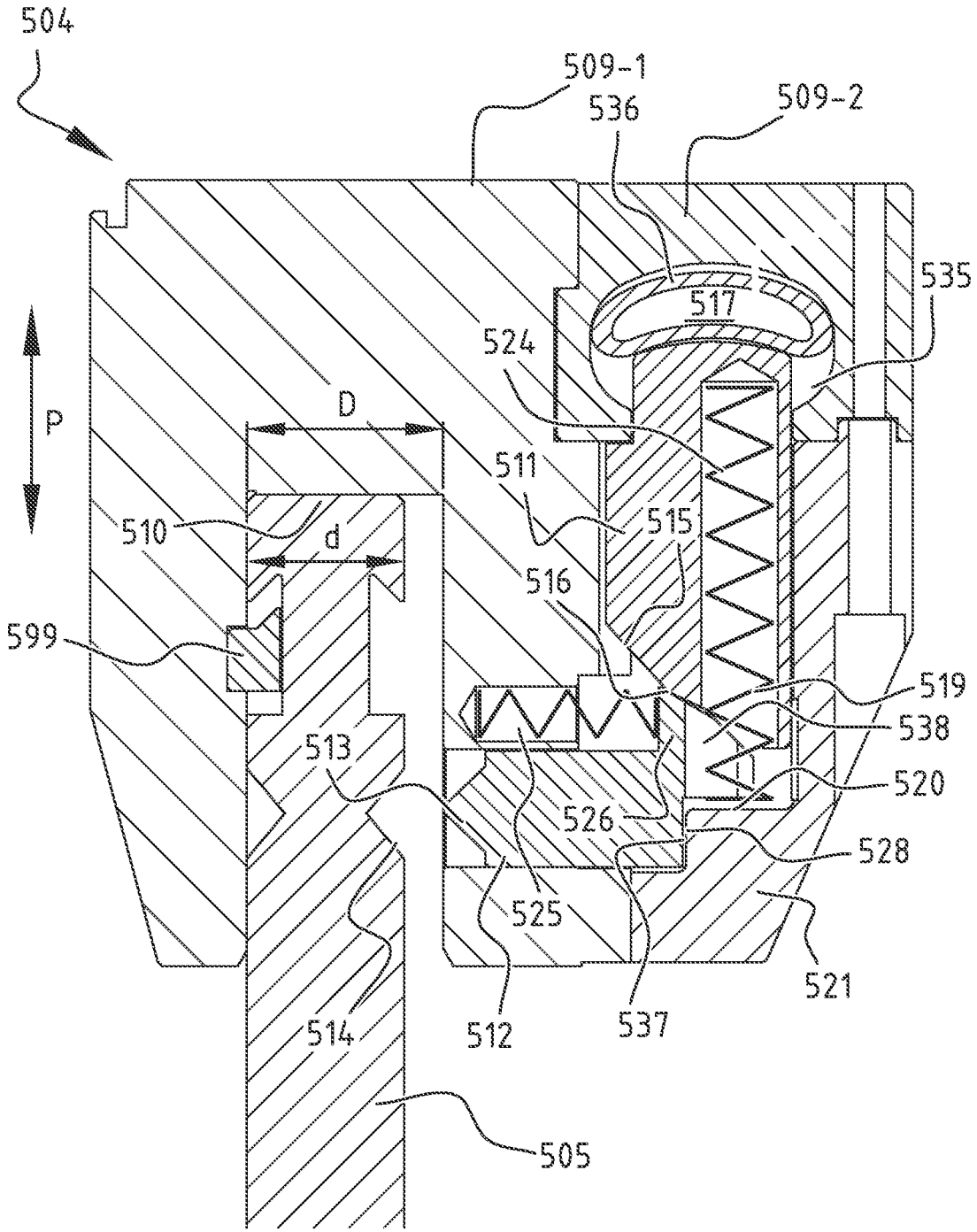

FIGS. 7A-7C show a clamping system 504 that differs only from the clamping system 204 described in relation to FIGS. 3A-4B in the features described below. Firstly, the elongate beam 509-1, 509-2 consists of two separate components 509-1 and 509-2. The main body 509-1 of the elongate beam can be manufactured separate from the auxiliary body 509-2, and attached to it later. The pressure chamber 217 is formed by a pneumatic hose 536 which has a deformable wall. The hose 536 runs in the longitudinal direction L of the elongate beam 509-1, 509-2 through a cavity 535 therein. The hose 536 expands when fluid is pressurized in the pressure chamber 517, and contracts when pressure is released. As the hose 536 expands (see FIG. 7B), it pushes the actuating member 511 to its active position. The first compression spring 519 aids in pushing fluid out of the pressure chamber 517 when pressure therein in lowered, by pushing the actuating member 511 upwards (see FIG. 7C). Moreover, the protrusion 526 of the clamping element 512 is placed on a top side of the clamping element 512 for engaging the second compression spring 525. This leaves free an end surface 537 of the clamping element 512 for engaging the second stop 528. Further, the clamping element 512 is provided with a recess 538 for accommodating the first compression spring 519 when the clamping element 512 is in the second position, i.e. moved towards the right in the figures. No first stop or movement limiter of the actuating member is provided, as was the case in the embodiment of FIGS. 3A-4B. Finally, a protrusion 599 is provided that forms a hook inside the receiving space 510. The protrusion 599 is used to hang the tool 505. For insertion or removal, the tool 505 needs to be moved around the protrusion 599. As such, the receiving space 510 has a relatively large width D as compared to the tool 505 which has a smaller width d. Accordingly, the clamping element 512 has a relatively large stroke for clamping the tool 505.

Figure 8:
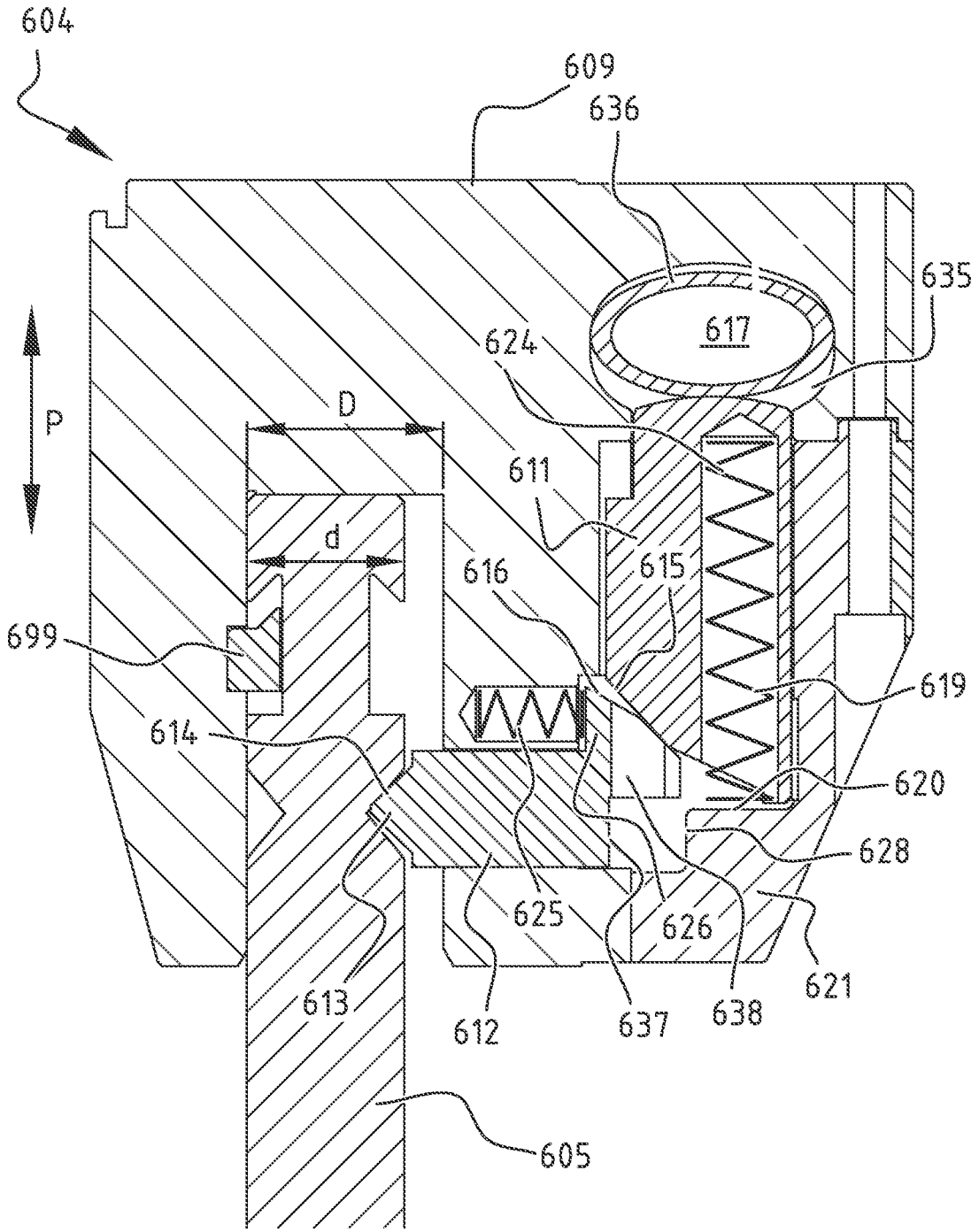
FIG. 8 shows schematically a variation on the clamping system of FIGS. 7A-7C.

FIG. 8 shows a clamping system 604 that differs from the clamping system 504 of FIGS. 7A-7C in that the elongate beam 709 is made of one piece of material. Accordingly, the cavity 635 is formed integrally in that one piece of the elongate beam 609.

Figure 9:
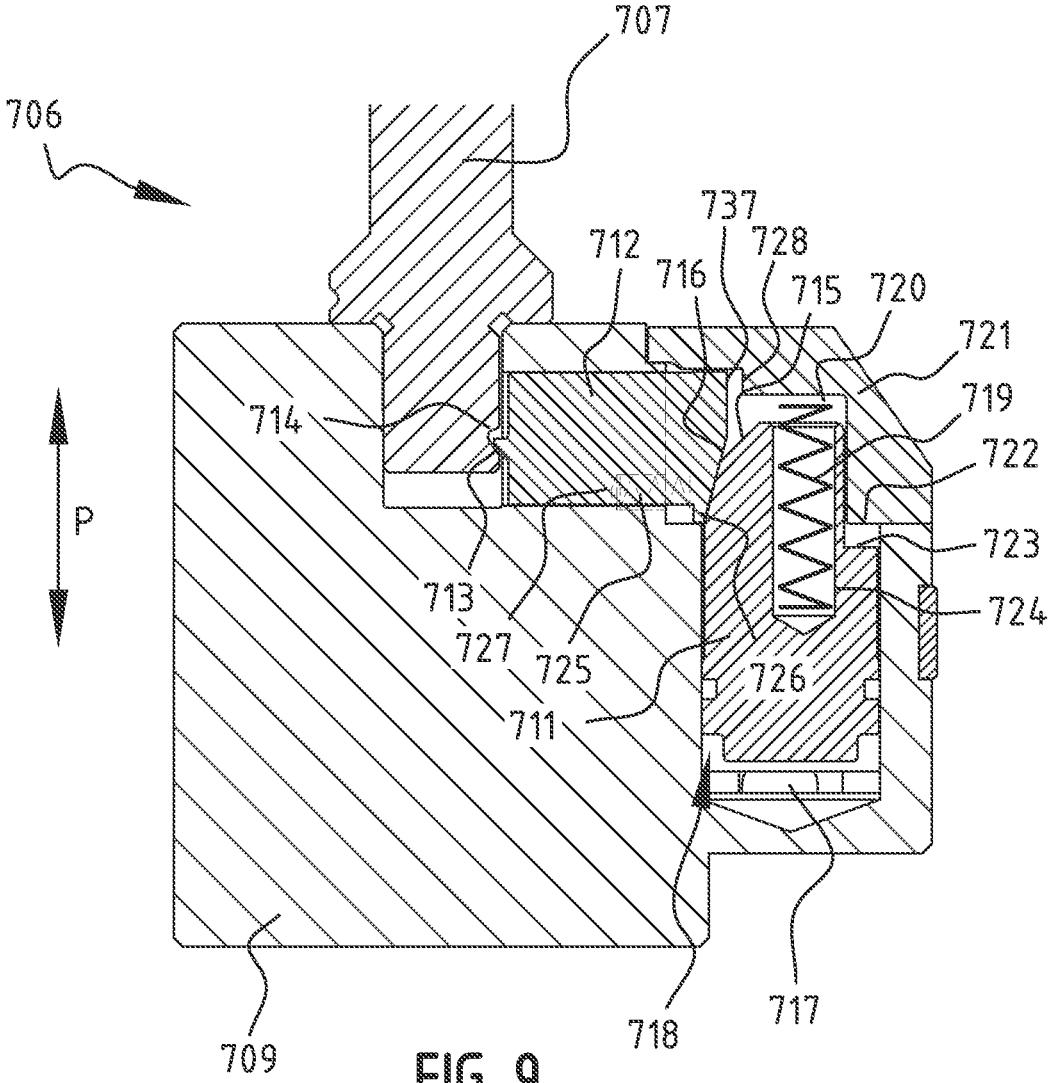
FIG. 9 shows schematically a transversal cross-sectional view of yet another clamping system.

FIG. 9 shows a bottom clamping system 706, that has the features of the clamping system 204 described in relation to FIGS. 2A-3B, apart from a different position of the protrusion 725 of the clamping element 712. The protrusion 726 leaves free an end surface 737 to cooperate with the second stop 728.

Obviously, the bottom clamping system 706 could be altered by applying any of the features described above, such as the separate elongate beam and/or the separate cylinder in the cavity and/or the hose as a pressure chamber.

Figure 10A:
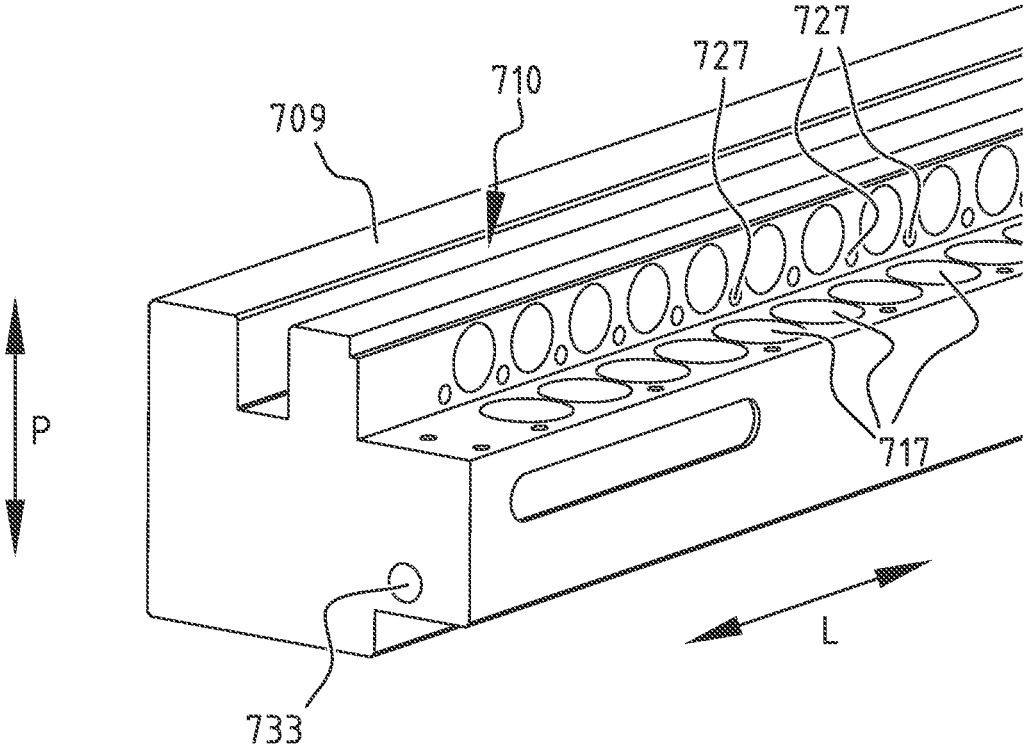
FIGS. 10A and 10B show schematically a perspective view of an elongate beam of the clamping system of FIG. 9 and of a longitudinal cross-sectional thereof.
Figure 10B:
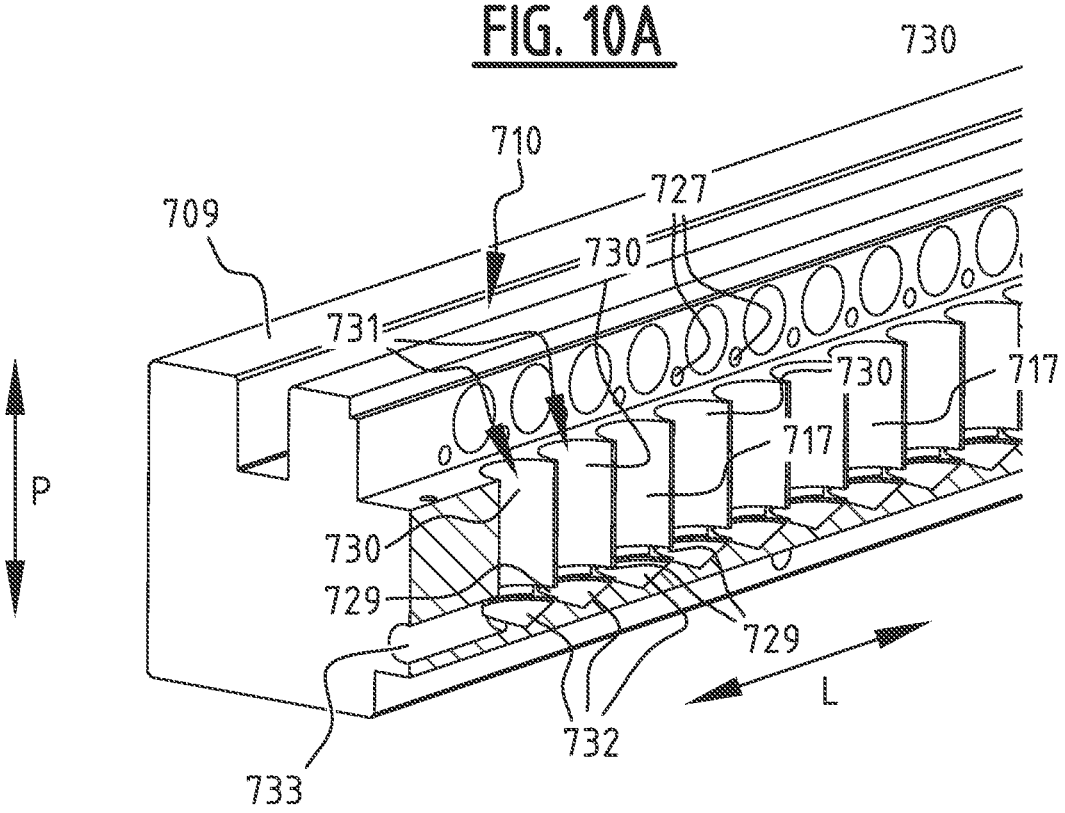

FIGS. 10A and 10B show the elongate beam 709 in more detail. Its features are similar to those described in relation to FIGS. 3A and 3B.

Figure 11A:
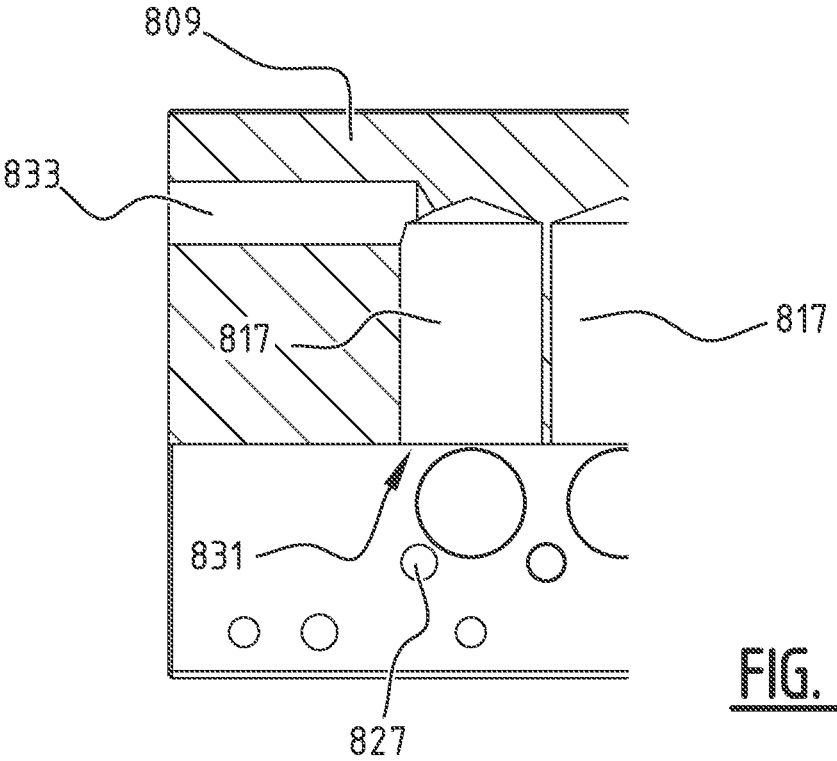
FIGS. 11A-11D show schematically steps in a method of interconnecting cavities in an elongate beam.
Figure 11B:
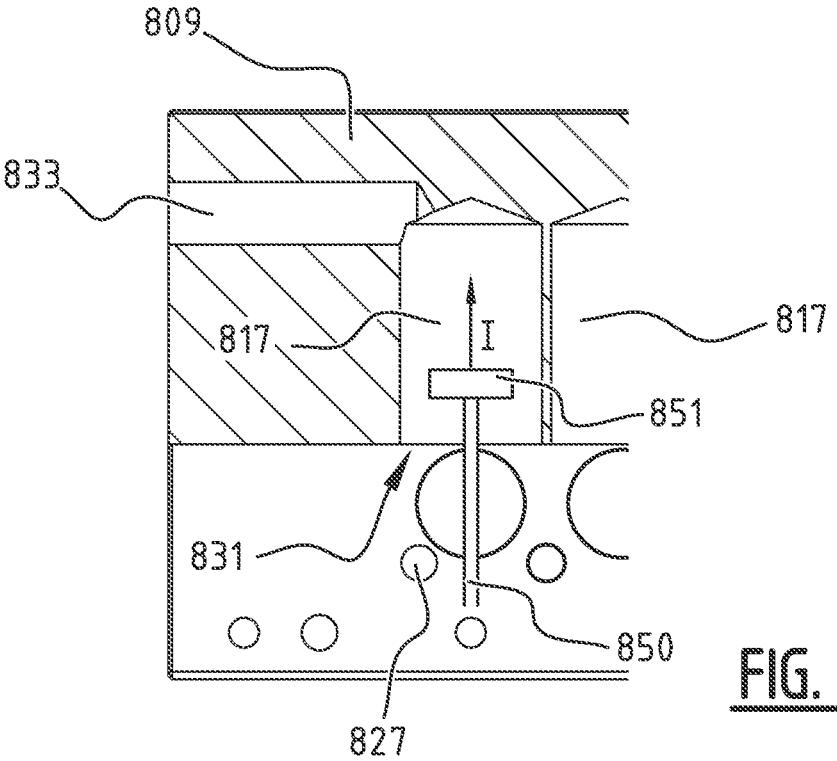
Figure 11C:
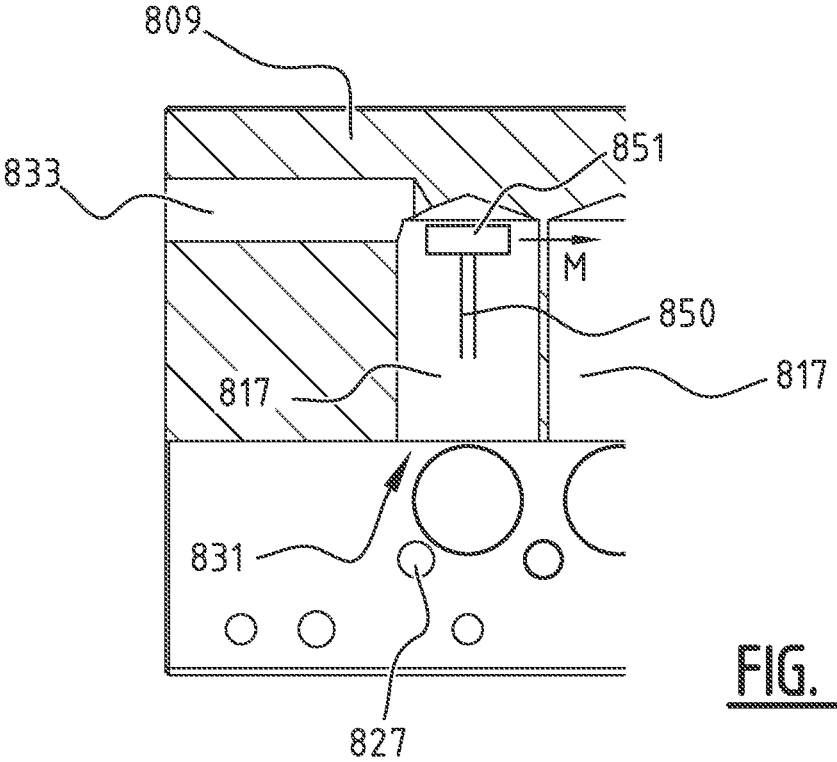
Figure 11D:
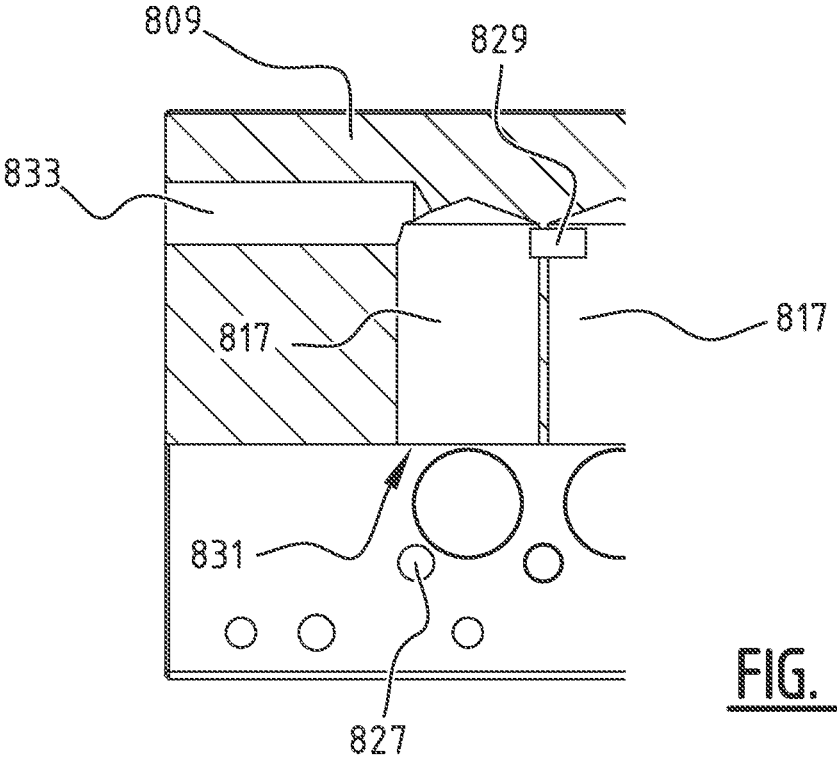

FIGS. 11A-11D show how cavities 817 in an elongate beam 809 can be interconnected internally. First, an elongate beam 809 is provided (see FIG. 11A) with cavities 817 therein. The cavities are not yet interconnected. Then (see FIG. 11B) a milling tool is inserted through the opening 831 of one cavity 817. The milling tool has a narrow stem 850 and a larger head 851. The milling tool is inserted in an insertion direction I. Then (see FIG. 11C) the milling tool is moved in a machining direction M towards another cavity 817, thereby eroding material of the elongate beam 809 and creating a channel 829 between the two cavities. As shown in FIG. 11D, the cavities 817 are thereafter interconnected.

Figure 12:
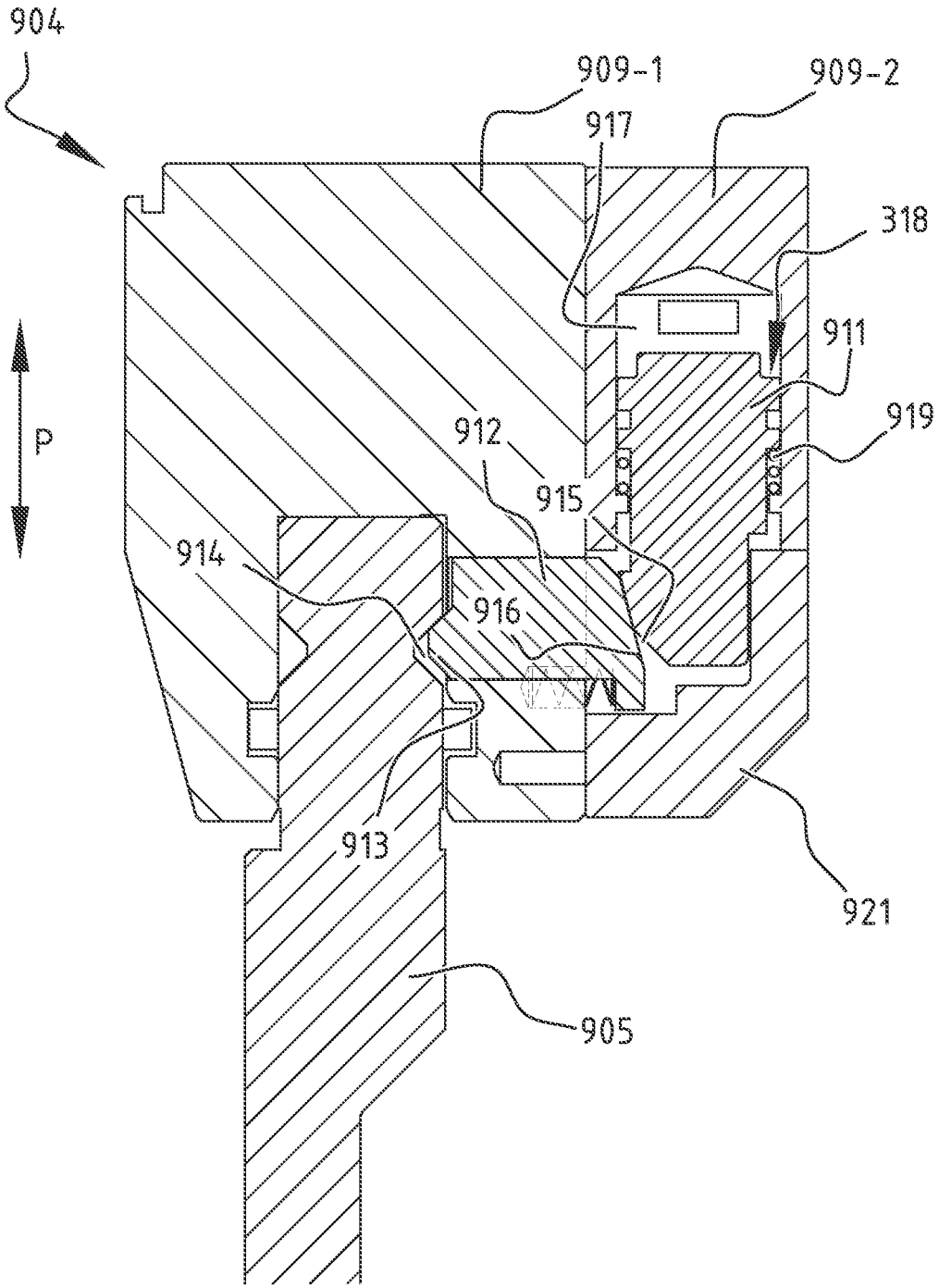
FIG. 12 shows schematically a variation on the clamping system of FIG. 5.

FIG. 12 shows yet another clamping system 904, that differs from the clamping system 304 described in relation to FIG. 5 in that the first compression spring 919 is provided around the actuating member 911 instead of in a cavity therein. No first stop has been shown in FIG. 12. The first compression spring of other clamping systems shown in this application could also be provided around their respective actuating members.

Although the invention has been described hereabove with reference to a number of specific examples and embodiments, the invention is not limited thereto. Instead, the invention also covers the subject matter defined by the claims, which now follow.

The invention claimed is:

1. A clamping system for a press brake, the clamping system comprising:

an elongate beam comprising a receiving space for receiving a part of a bending tool, the elongate beam having at least two cavities formed therein, further comprising a piston either arranged directly in each of the at least two cavities, or in a cylinder in each of the at least two cavities, wherein each of the at least two cavities has an opening to the exterior of the elongate beam, and wherein the at least two cavities are interconnected internally via a channel extending between side walls of the at least two cavities.

2. The clamping system according to claim 1, further comprising a second channel extending from at least one of the at least two cavities to an exterior of the elongate beam.

3. A press brake comprising at least one clamping system according to claim 1.

4. A method of manufacturing an elongate beam for a clamping system for a press brake, the elongate beam comprising a receiving space for receiving a part of a bending tool, the method comprising the steps of:

a) providing an elongate beam;

b) forming at least two cavities in said elongate beam, each of the two cavities having an opening to the exterior of the elongate beam; and c) providing a fluid connection to each of the at least two cavities;

the method further comprising arranging a piston either directly in each of the at least two cavities, or in a cylinder in each of the at least two cavities, wherein said providing the fluid connection is performed by interconnecting the at least two cavities by inserting a tool into at least one of the at least two cavities through its opening, and machining towards another one of the at least two cavities.

5. The method according to claim 4, wherein step c) is performed by machining from the one of the at least two cavities until the one of the at least two cavities is interconnected with the other one of the at least two cavities.

6. The method according to claim 4, further comprising forming a channel from at least one of the at least two cavities to an exterior of the elongate beam.

7. The method according to claim 4, further comprising providing the interconnection in a side wall of the at least two cavities.

8. The method according to claim 4, further comprising providing the interconnection in an end zone opposite the opening of each cavity.

9. The method according to claim 4, comprising inserting the tool in an insertion direction and consecutively moving the tool in a machining direction, wherein the machining direction is at a non-zero angle with the insertion direction, optionally wherein the machining direction is substantially perpendicular to the insertion direction.

10. The method according to claim 9, wherein the tool comprises a shaft and a head, the head having a larger cross-sectional dimension than the shaft.

11. The method according to claim 4, further comprising performing step c) by milling.

12. The method according to claim 4, further comprising performing step b) by milling or drilling.

13. The method according to claim 4, further comprising forming the cavities in step b) in a part of the elongate beam that is integral with the part of the elongate beam comprising the receiving space.

14. A clamping system for a press brake, the clamping system comprising:

an elongate beam comprising a receiving space for receiving a part of a bending tool, the elongate beam having at least two cavities formed therein, further comprising a cylinder in each of the at least two cavities, each cylinder being distinct from the cavity in which it is arranged, wherein the clamping system further comprises a piston in each cylinder, wherein each of the at least two cavities has an opening to the exterior of the elongate beam, and wherein the at least two cavities are interconnected internally.

15. The clamping system according to claim 14, wherein the at least two cavities are interconnected via their side walls.

* * * * *